US006722325B2

(12) United States Patent
Shimizu et al.

(10) Patent No.: US 6,722,325 B2
(45) Date of Patent: Apr. 20, 2004

(54) VARIABLE VALVE CONTROL APPARATUS FOR ENGINE AND METHOD THEREOF

(75) Inventors: Hirokazu Shimizu, Atsugi (JP); Kenichi Machida, Atsugi (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/278,077

(22) Filed: Oct. 23, 2002

(65) Prior Publication Data

US 2003/0075128 A1 Apr. 24, 2003

(30) Foreign Application Priority Data

Oct. 23, 2001 (JP) ..... 2001-325210

(51) Int. Cl.[7] ..... F01L 1/34

(52) U.S. Cl. ..... 123/90.15; 123/90.16; 123/90.17; 123/90.27

(58) Field of Search ..... 123/90.15, 90.16, 123/90.17, 90.18, 90.27, 90.31, 406.62, 612, 406.11, 406.12, 406.35, 406.58

(56) References Cited

U.S. PATENT DOCUMENTS

| | | | | |
|---|---|---|---|---|
| 5,482,012 A | * | 1/1996 | Yoshioka | 123/90.15 |
| 6,502,535 B2 | * | 1/2003 | Nakamura | 123/90.15 |
| 6,598,569 B2 | * | 7/2003 | Takemura et al. | 123/90.15 |
| 6,612,274 B2 | * | 9/2003 | Iizuka et al. | 123/90.16 |

FOREIGN PATENT DOCUMENTS

| | | |
|---|---|---|
| JP | 6-272580 | 9/1994 |
| JP | 2001-12262 | 1/2001 |

* cited by examiner

*Primary Examiner*—Thomas Denion
*Assistant Examiner*—Ching Chang
(74) *Attorney, Agent, or Firm*—Foley & Lardner

(57) ABSTRACT

In a constitution to control a valve lift amount of an intake valve to achieve a target intake air amount, a target valve overlap amount is calculated based on an engine load and an engine rotation speed, and target valve timing is calculated based on a target valve lift amount and the target valve overlap amount, so that the valve overlap amount is maintained at a requested value corresponding to operating conditions.

19 Claims, 13 Drawing Sheets

VARIABLE VALVE CONTROL APPARATUS FOR ENGINE AND METHOD THEREOF

FIELD OF THE INVENTION

The present invention relates to a variable valve control apparatus and a variable valve control method for an engine provided with a mechanism varying a valve lift amount and valve timing.

RELATED ART OF THE INVENTION

Heretofore, there has been known an apparatus in which a target torque is calculated based on an accelerator opening and an engine rotation speed, and an operating characteristic of an intake valve is varied so that a target intake air amount corresponding to the target torque can be obtained (refer to Japanese Unexamined Patent Publication No. 6-272580).

Further, there has also been known a variable valve mechanism varying continuously valve lift amounts and operating angles of engine valves (intake valve and exhaust valve) (refer to Japanese Unexamined Patent Publication No. 2001-012262) Here, when a valve lift amount of intake valve is controlled in order to obtain a target intake air amount, opening timing of the intake valve is varied with a change in the valve lift amount, and thereby a valve overlap amount is varied.

Then, as a result that the valve overlap amount is varied, there often occurs a reduction in volume efficiency and the blow-by and spit-back of unburned gas.

SUMMARY OF THE INVENTION

It is therefore an object of the present invention to provide a variable valve control apparatus and a variable valve control method for an engine, which is capable of avoiding a reduction in volume efficiency and the blow-by and spit-back of unburned gas, caused by a change in valve overlap amount, while controlling a valve lift amount to a requested amount.

In order to accomplish the above-mentioned object, according to the present invention, after a target valve lift amount and a target valve overlap amount are calculated, a target valve timing is calculated based on the target valve lift amount and the target valve overlap amount, and then, a valve lift amount and valve timing of an engine valve are controlled based on the target valve lift amount and the target valve timing.

The other objects and features of the invention will become understood from the following description with reference to the accompanying drawings.

DESCRIPTION OF THE PREFERRED EMBODIMENT

Figure 1:
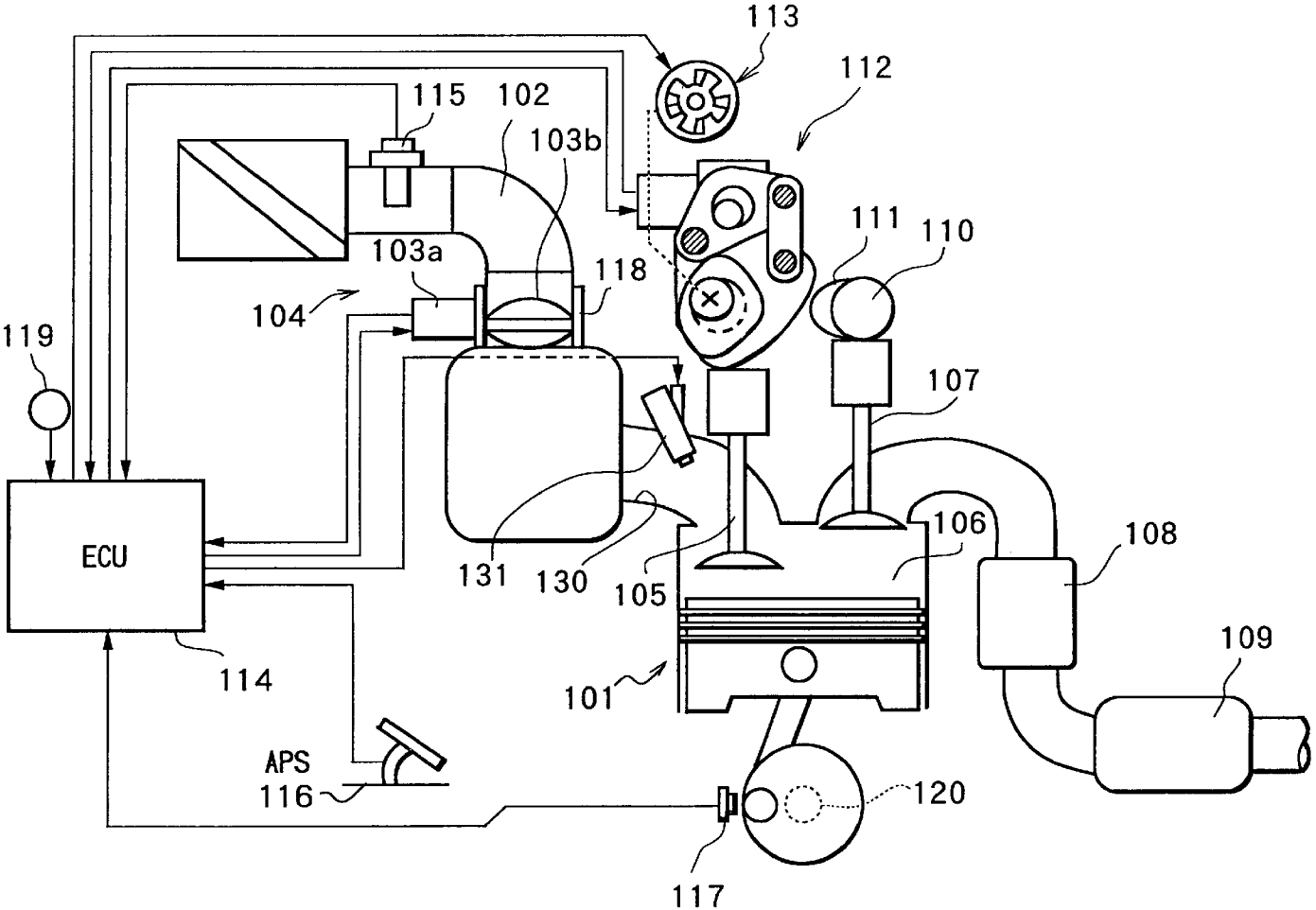
FIG. 1 is a diagram of a system structure of an engine.

FIG. 1 is a structural diagram of an engine for vehicle in embodiments.

In an intake passage 102 of an engine 101, an electronically controlled throttle 104 is disposed for driving a throttle valve 103*b* to open and close by a throttle motor 103*a*.

Air is sucked into a combustion chamber 106 via electronically controlled throttle 104 and an intake valve 105.

A combusted exhaust gas of engine 101 is discharged from combustion chamber 106 via an exhaust valve 107, purified by a front catalyst 108 and a rear catalyst 109, and then emitted into the atmosphere.

Exhaust valve 107 is driven by a cam 111 axially supported by an exhaust side camshaft 110, to open and close at fixed valve lift amount, valve operating angle and valve timing.

A valve lift amount and a valve operating angle of intake valve 105 is varied continuously by a variable valve event and lift mechanism (VEL) 112, and valve timing thereof is varied continuously by a variable valve timing mechanism (VTC) 113.

An engine control unit (ECU) 114 incorporating therein a microcomputer, controls electronically controlled throttle 104, variable valve event and lift mechanism (VEL) 112 and variable valve timing mechanism (VTC) 113, so that a target intake air amount corresponding to an accelerator opening can be obtained.

Engine control unit 114 receives various detection signals from an air flow meter 115 detecting an intake air amount Q of engine 101, an accelerator pedal sensor APS 116 detecting an opening APO of an accelerator pedal, a crank angle sensor 117 taking out a rotation signal from a crankshaft 120, a throttle sensor 118 detecting an opening TVO of throttle valve 103*b*, a water temperature sensor 119 detecting a cooling water temperature Tw of engine 101, and the like.

In engine control unit 114, an engine rotation speed Ne is calculated based on the rotation signal output from crank angle sensor 117.

Further, an electromagnetic fuel injection valve 131 is disposed on an intake port 130 at the upstream side of intake valve 105 of each cylinder.

Fuel injection valve 131 injects fuel adjusted at a predetermined pressure toward intake valve 105, when driven to open by an injection pulse signal from engine control unit 114.

Figure 2:
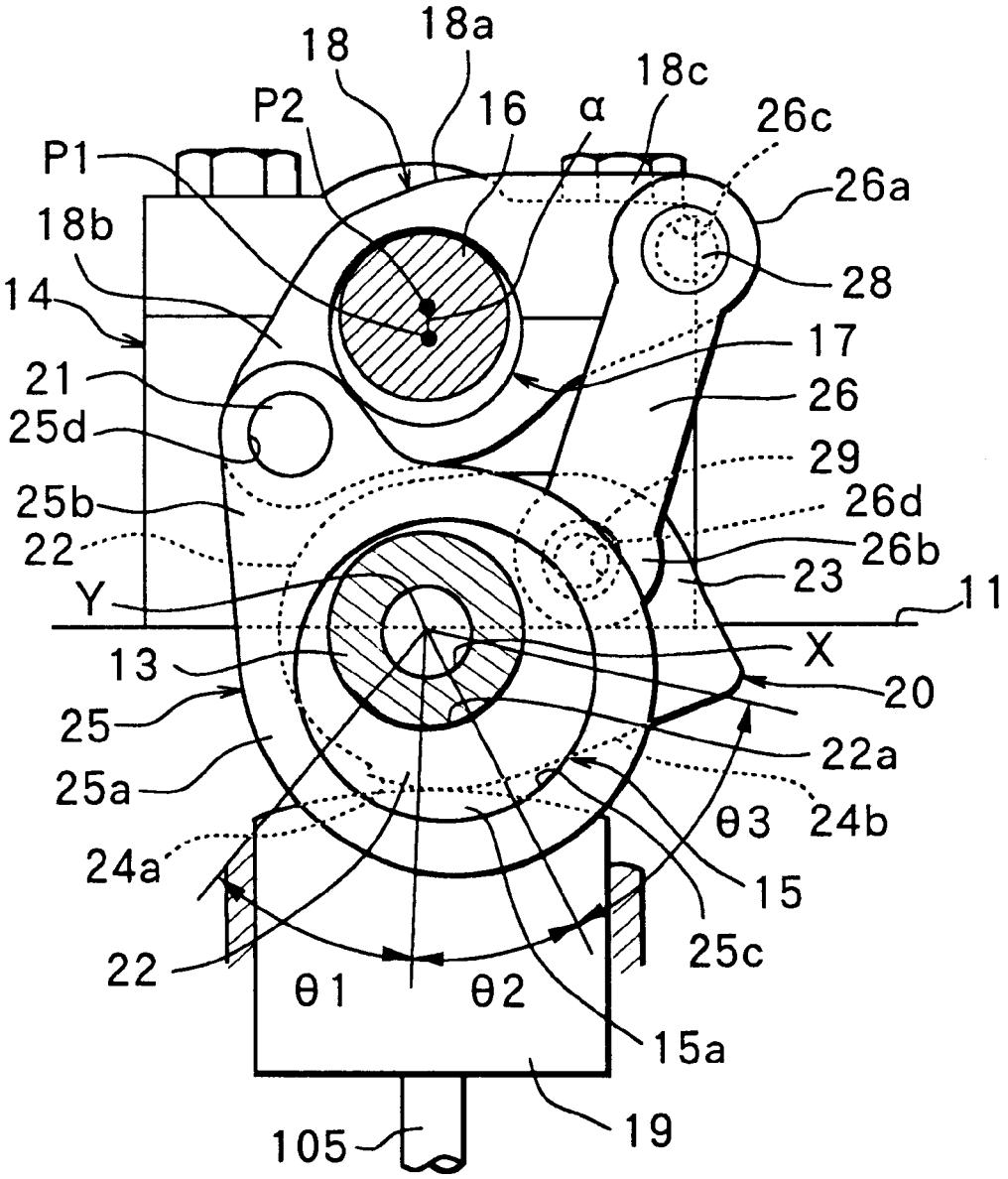
FIG. 2 is a cross section view showing a variable valve event and lift (VEL) mechanism (A—A cross section of FIG. 3).
Figure 3:
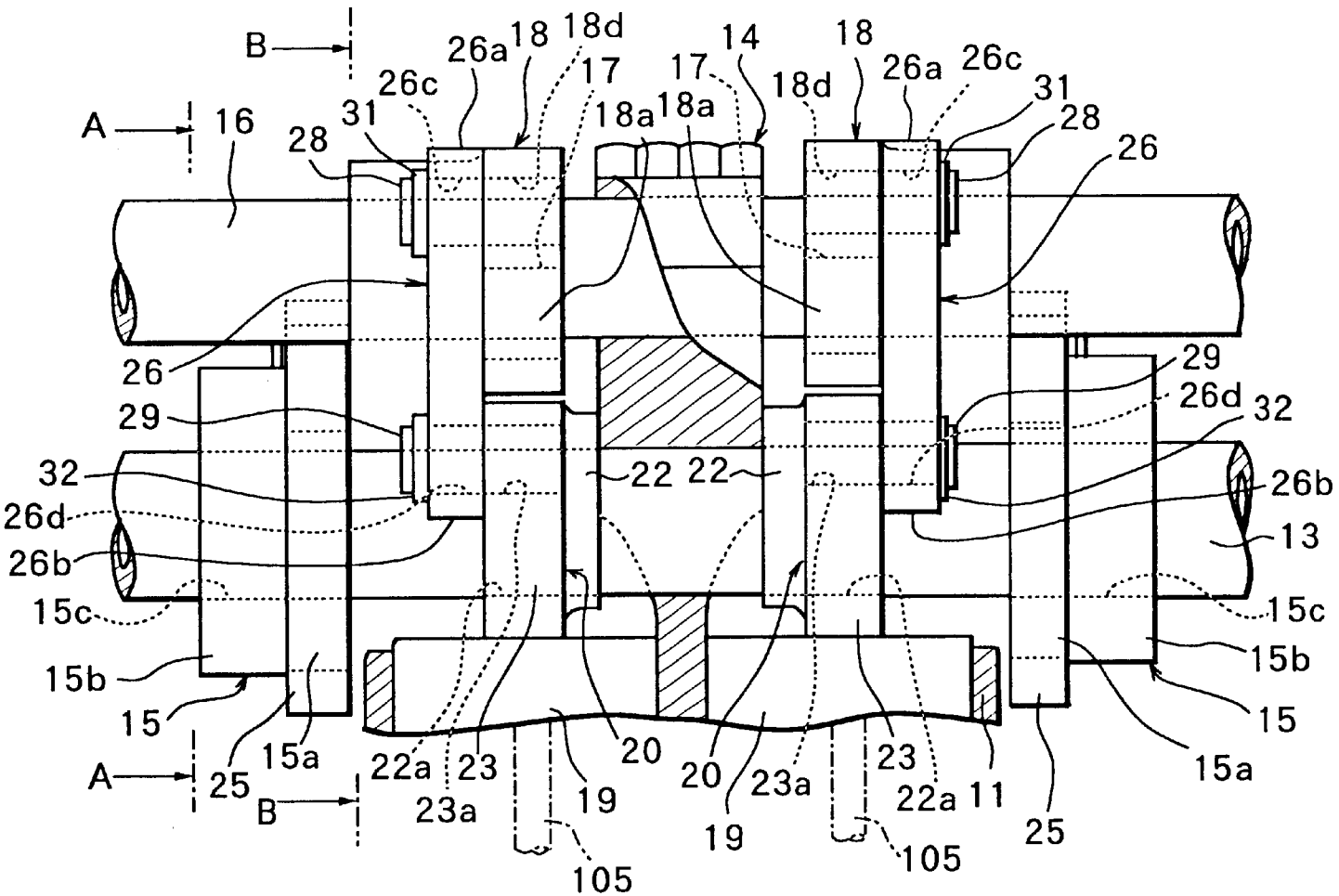
FIG. 3 is a side elevation view of the variable valve event and lift (VEL) mechanism.
Figure 4:
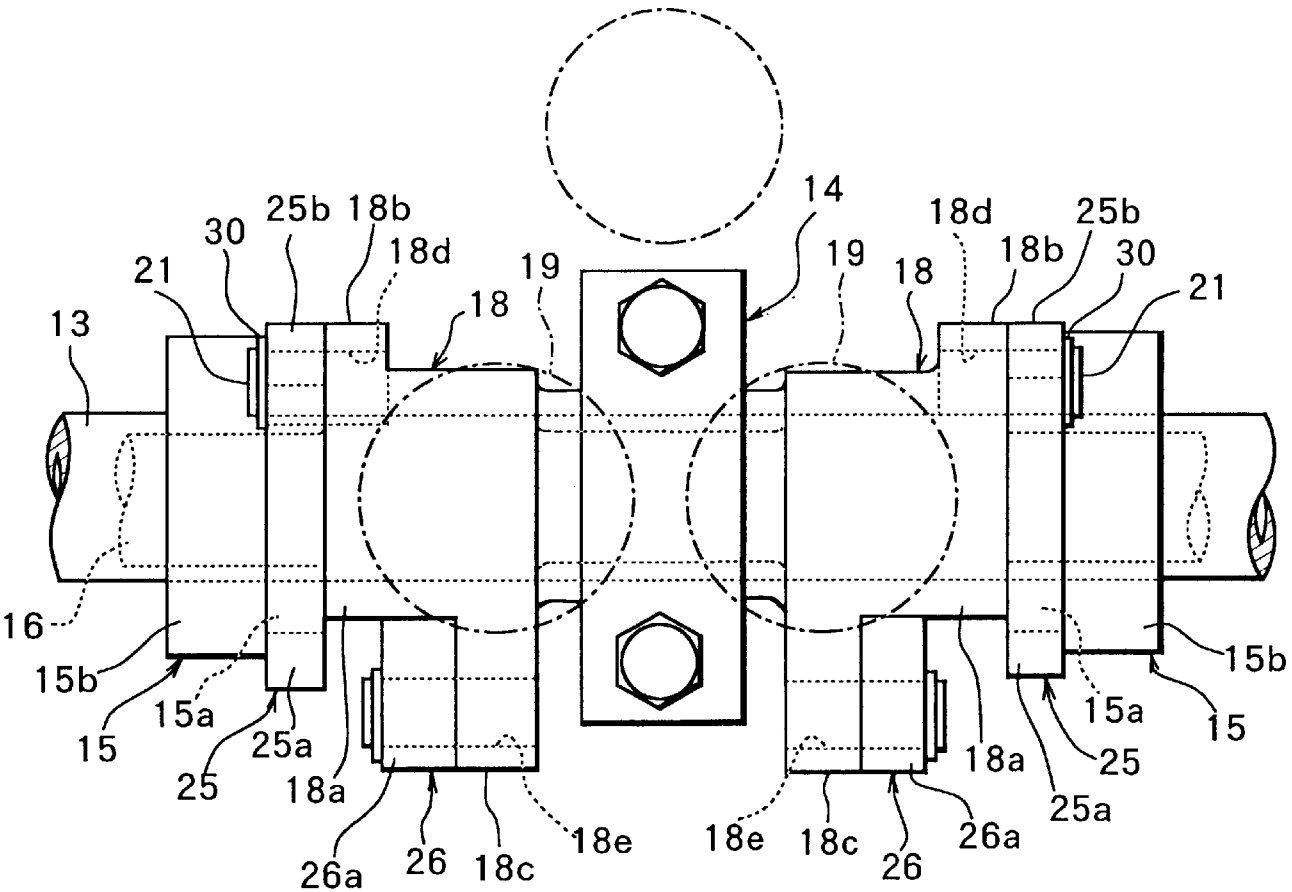
FIG. 4 is a top plan view of the variable valve event and lift (VEL) mechanism.

FIG. 2 to FIG. 4 show in detail the structure of variable valve event and lift (VEL) mechanism 112.

Variable valve event and lift (VEL) mechanism 112 shown in FIG. 2 to FIG. 4 includes a pair of intake valves 105, 105, a camshaft (drive shaft) 13 rotatably supported by a cam bearing 14 of a cylinder head 11, two eccentric cams (drive cams) 15, 15 axially supported by camshaft 13, a control shaft 16 rotatably supported by cam bearing 14 and arranged in parallel at an upper position of camshaft 13, a pair of rocker arms 18, 18 swingingly supported by control shaft 16 through a control cam 17, and a pair of swing cams 20, 20 disposed to upper end portions of intake valves 105, 105 through valve lifters 19, 19, respectively.

Eccentric cams 15, 15 are connected with rocker arms 18, 18 by link arms 25, 25, respectively.

Rocker arms 18, 18 are connected with swing cams 20, 20 by link members 26, 26.

Rocker arms 18, 18, link arms 25, 25, and link members 26, 26 constitute a transmission mechanism.

Figure 5:
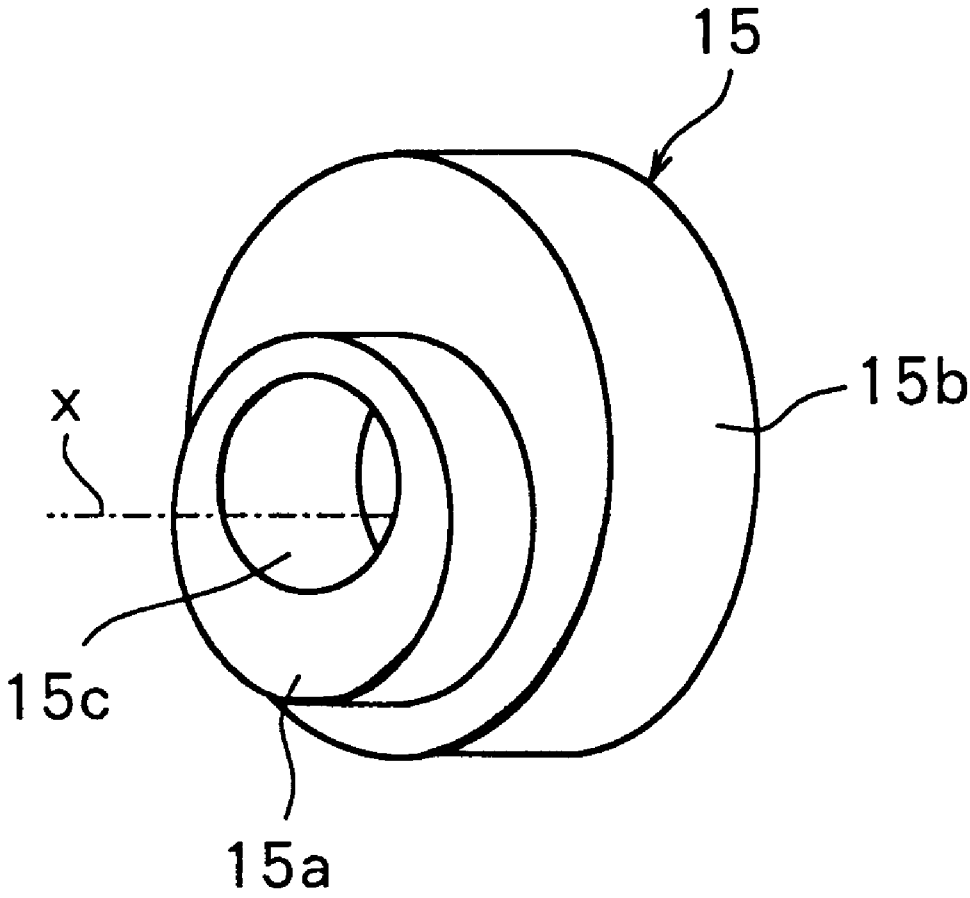
FIG. 5 is a perspective view showing an eccentric cam for use in the variable valve event and lift (VEL) mechanism.

Each eccentric cam 15, as shown in FIG. 5, is formed in a substantially ring shape and includes a cam body 15*a* of small diameter, a flange portion 15*b* integrally formed on an outer surface of cam body 15*a*.

An insertion hole 15*c* is formed through the interior of eccentric cam 15 in an axial direction, and also a center axis X of cam body 15*a* is biased from a center axis Y of camshaft 13 by a predetermined amount.

Eccentric cams 15, 15 are pressed and fixed to camshaft 13 via camshaft insertion holes 15*c* so as to position at outsides of valve lifters 19, 19, respectively.

Each rocker arm 18, as shown in FIG. 4, is bent and formed in a substantially crank shape, and a central base portion 18*a* thereof is rotatably supported by control cam 17.

A pin hole 18*d* is formed through one end portion 18*b* which is formed to protrude from an outer end portion of base portion 18*a*. A pin 21 to be connected with a tip portion of link arm 25 is pressed into pin hole 18*d*.

A pin hole 18*e* is formed through the other end portion 18*c* which is formed to protrude from an inner end portion of base portion 18*a*. A pin 28 to be connected with one end portion 26*a* (to be described later) of each link member 26 is pressed into pin hole 18*e*.

Control cam 17 is formed in a cylindrical shape and fixed to a periphery of control shaft 16. As shown in FIG. 2, a center axis P1 position of control cam 17 is biased from a center axis P2 position of control shaft 16 by $\alpha$.

Figure 6:
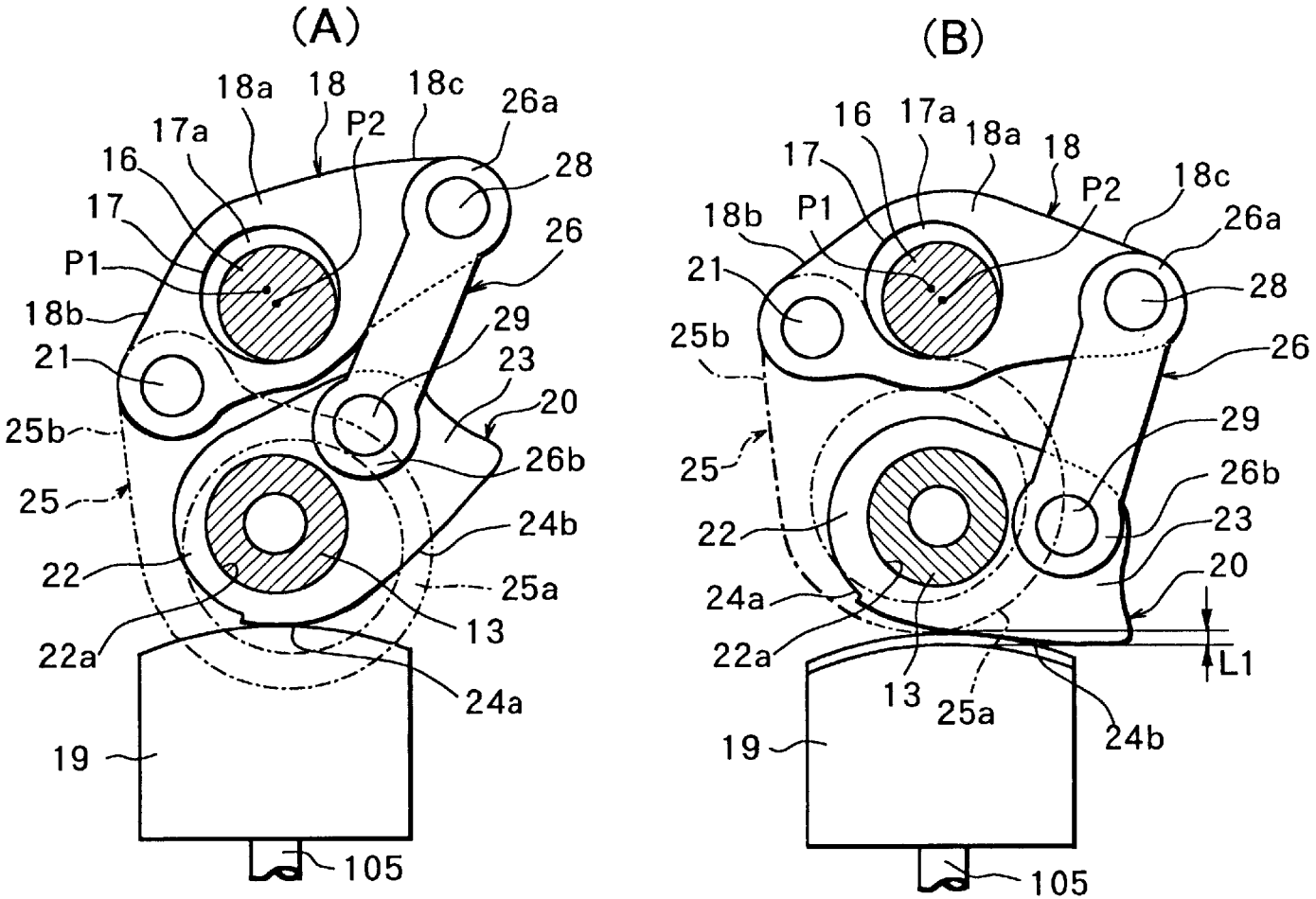
FIG. 6 is a cross section view showing an operation of the variable valve event and lift (VEL) mechanism at a low lift condition (B—B cross section view of FIG. 3).
Figure 7:
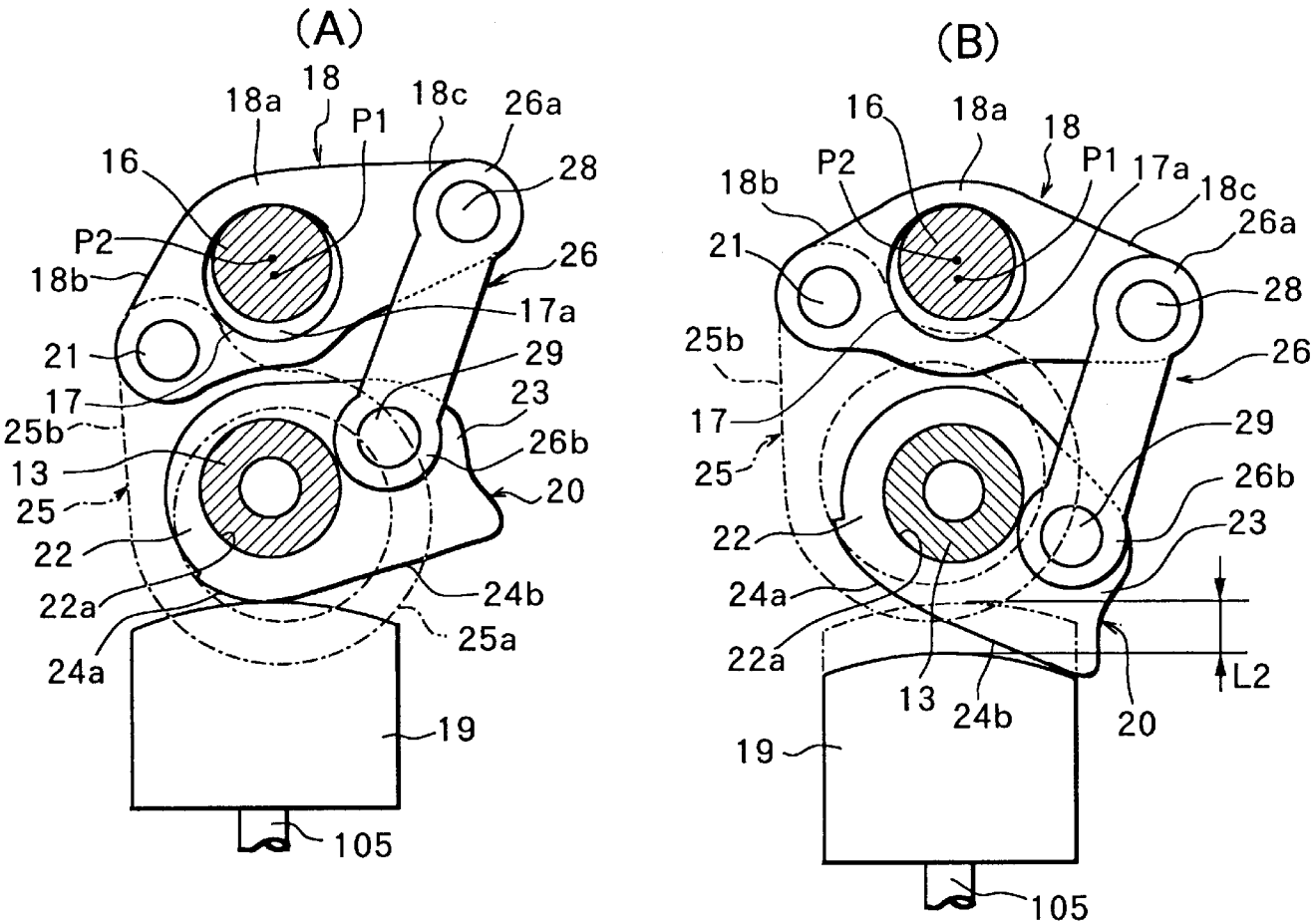
FIG. 7 is a cross section view showing an operation of the variable valve event and lift (VEL) mechanism at a high lift condition (B—B cross section view of FIG. 3).

Swing cam 20 is formed in a substantially lateral U-shape as shown in FIG. 2, FIG. 6 and FIG. 7, and a supporting hole 22*a* is formed through a substantially ring-shaped base end portion 22. Camshaft 13 is inserted into supporting hole 22*a* to be rotatably supported. Also, a pin hole 23*a* is formed through an end portion 23 positioned at the other end portion 18*c* of rocker arm 18.

A base circular surface 24*a* of base end portion 22 side and a cam surface 24*b* extending in an arc shape from base circular surface 24*a* to an edge of end portion 23, are formed on a bottom surface of swing cam 20. Base circular surface 24*a* and cam surface 24*b* are in contact with a predetermined position of an upper surface of each valve lifter 19 corresponding to a swing position of swing cam 20.

Figure 8:
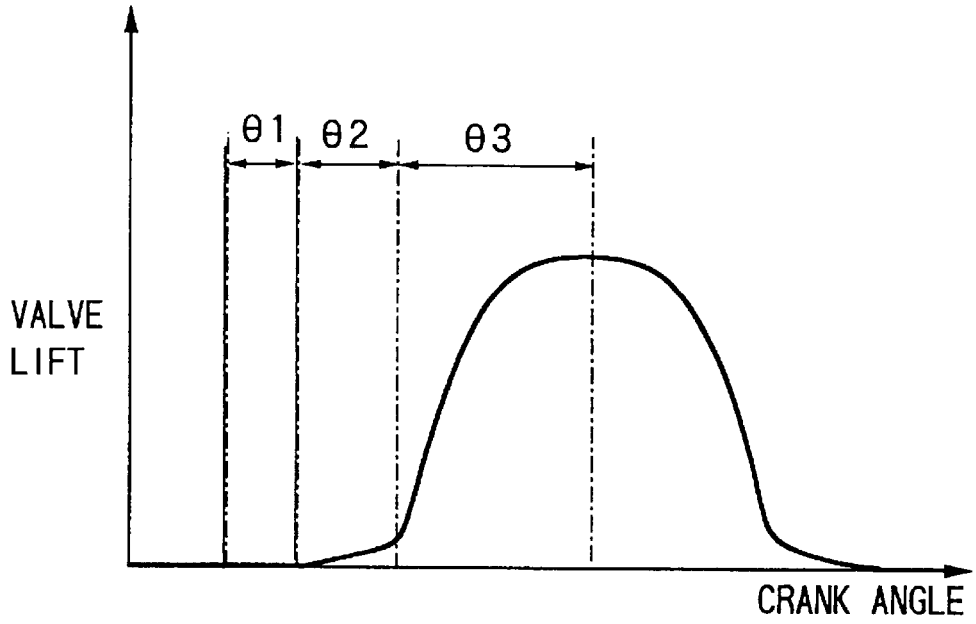
FIG. 8 is a valve lift characteristic diagram corresponding to a base end face and a cam surface of a swing cam in the variable valve event and lift (VEL) mechanism.

Namely, according to a valve lift characteristic shown in FIG. 8, as shown in FIG. 2, a predetermined angle range $\theta 1$ of base circular surface 24*a* is a base circle interval and a range of from base circle interval $\theta 1$ of cam surface 24*b* to a predetermined angle range $\theta 2$ is a so-called ramp interval, and a range of from ramp interval $\theta 2$ of cam surface 24*b* to a predetermined angle range $\theta 3$ is a lift interval.

Link arm 25 includes a ring-shaped base portion 25*a* and a protrusion end 25*b* protrudingly formed on a predetermined position of an outer surface of base portion 25*a*. A fitting hole 25*c* to be rotatably fitted with the outer surface of cam body 15*a* of eccentric cam 15 is formed on a central position of base portion 25*a*. Also, a pin hole 25*d* into which pin 21 is rotatably inserted is formed through protrusion end 25*b*.

Link member 26 is formed in a linear shape of predetermined length and pin insertion holes 26*c*, 26*d* are formed through both circular end portions 26*a*, 26*b*. End portions of pins 28, 29 pressed into pin hole 18*d* of the other end portion 18*c* of rocker arm 18 and pin hole 23*a* of end portion 23 of swing cam 20, respectively, are rotatably inserted into pin insertion holes 26*c*, 26*d*.

Snap rings 30, 31, 32 restricting axial transfer of link arm 25 and link member 26 are disposed on respective end portions of pins 21, 28, 29.

In such a constitution, depending on a positional relation between the center axis P2 of control shaft 16 and the center axis P1 of control cam 17, as shown in FIG. 6 and FIG. 7, the valve lift amount is varied, and by driving control shaft 16 to rotate, the position of the center axis P2 of control shaft 16 relative to the center axis P1 of control cam 17 is changed.

Figure 10:
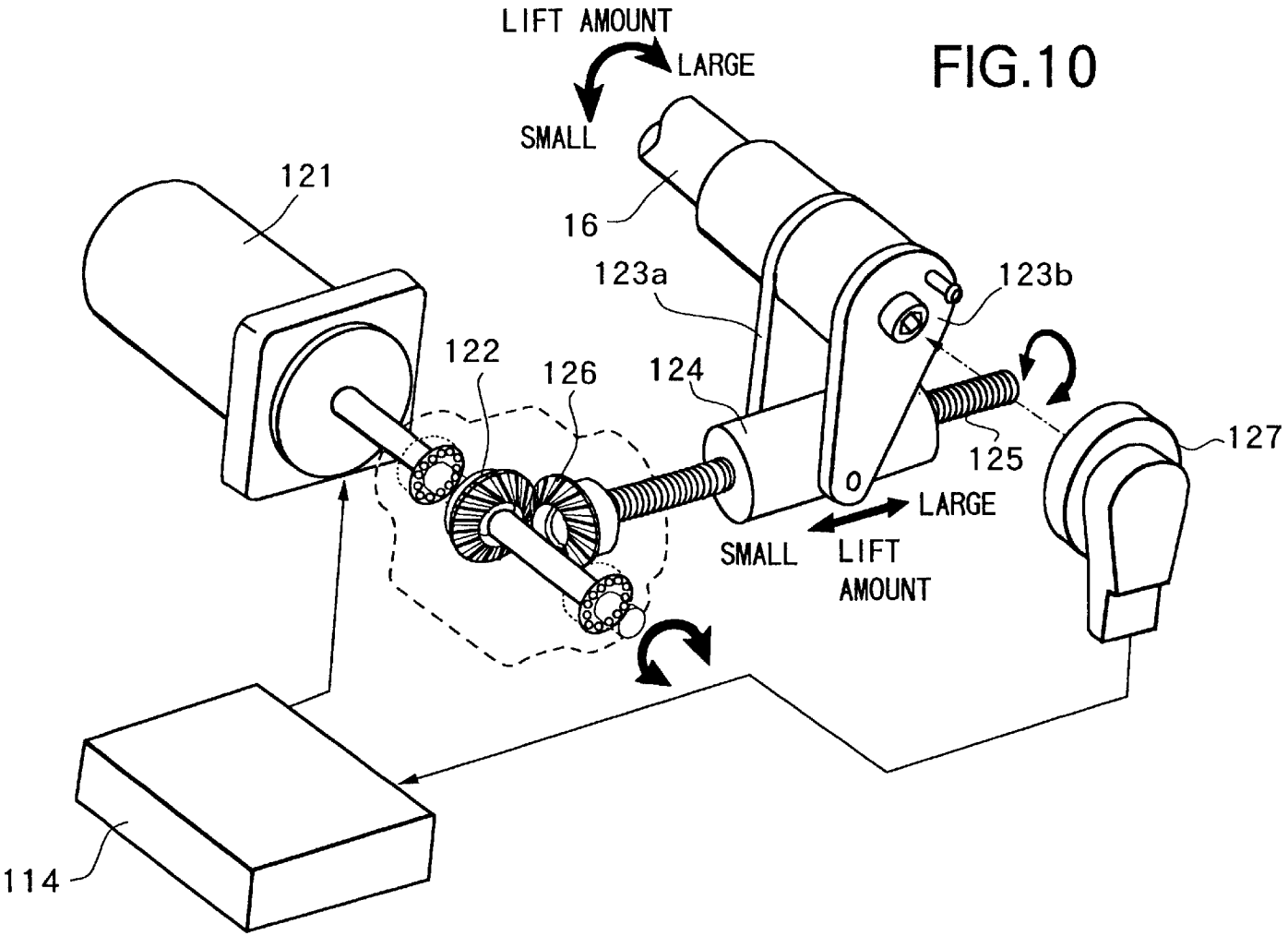
FIG. 10 is a perspective view showing a rotational driving mechanism of a control shaft in the variable valve event and lift mechanism.

Control shaft 16 is driven to rotate within a predetermined angle range by a DC servo motor (actuator) 121 as shown in FIG. 10.

Figure 9:
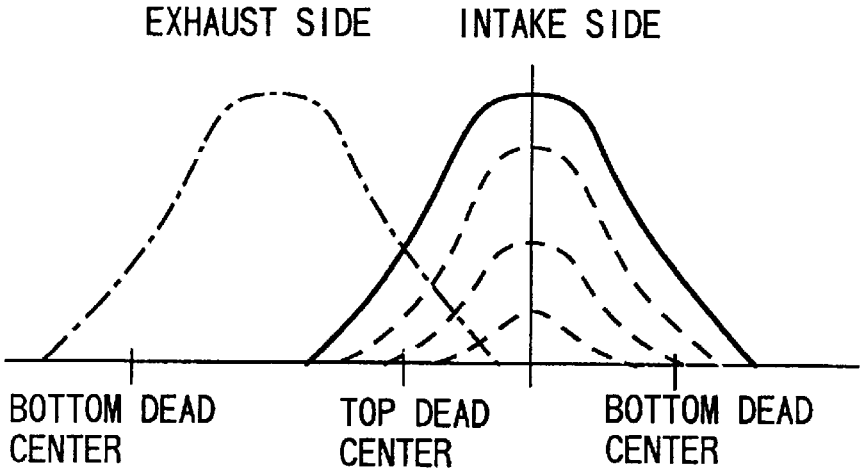
FIG. 9 is a characteristic diagram showing valve timing and a valve lift of the variable valve event and lift (VEL) mechanism.

By varying an operating angle of control shaft 16 by DC servo motor 121, the valve lift amount and valve operating angle of each of intake valves 105, 105 are continuously varied (refer to FIG. 9).

In this embodiment, the larger the operating angle of control shaft 16 becomes, the larger the lift amount of intake valve 105 becomes.

In FIG. 10, DC servo motor 121 is arranged so that the rotation shaft thereof is parallel to control shaft 16, and a bevel gear 122 is axially supported by the tip portion of the rotation shaft.

On the other hand, a pair of stays 123*a*, 123*b* are fixed to the tip end of control shaft 16. A nut 124 is swingingly supported around an axis parallel to control shaft 16 connecting the tip portions of the pair of stays 123*a*, 123*b*.

A bevel gear 126 meshed with bevel gear 122 is axially supported at the tip end of a threaded rod 125 engaged with nut 124. Threaded rod 126 is rotated by the rotation of DC servo motor 121, and the position of nut 124 engaged with threaded rod 125 is displaced in an axial direction of threaded rod 125, so that control shaft 16 is rotated.

Here, the valve lift amount is decreased as the position of nut 124 approaches bevel gear 126, while the valve lift amount is increased as the position of nut 124 gets away from bevel gear 126.

Further, a potentiometer type operating angle sensor 127 detecting the operating angle of control shaft 16 is disposed on the tip end of control shaft 16, as shown in FIG. 10.

Control unit 114 feedback controls DC servo motor (actuator) 121 so that an actual operating angle detected by operating angle sensor 127 coincides with a target operating angle.

Figure 11:
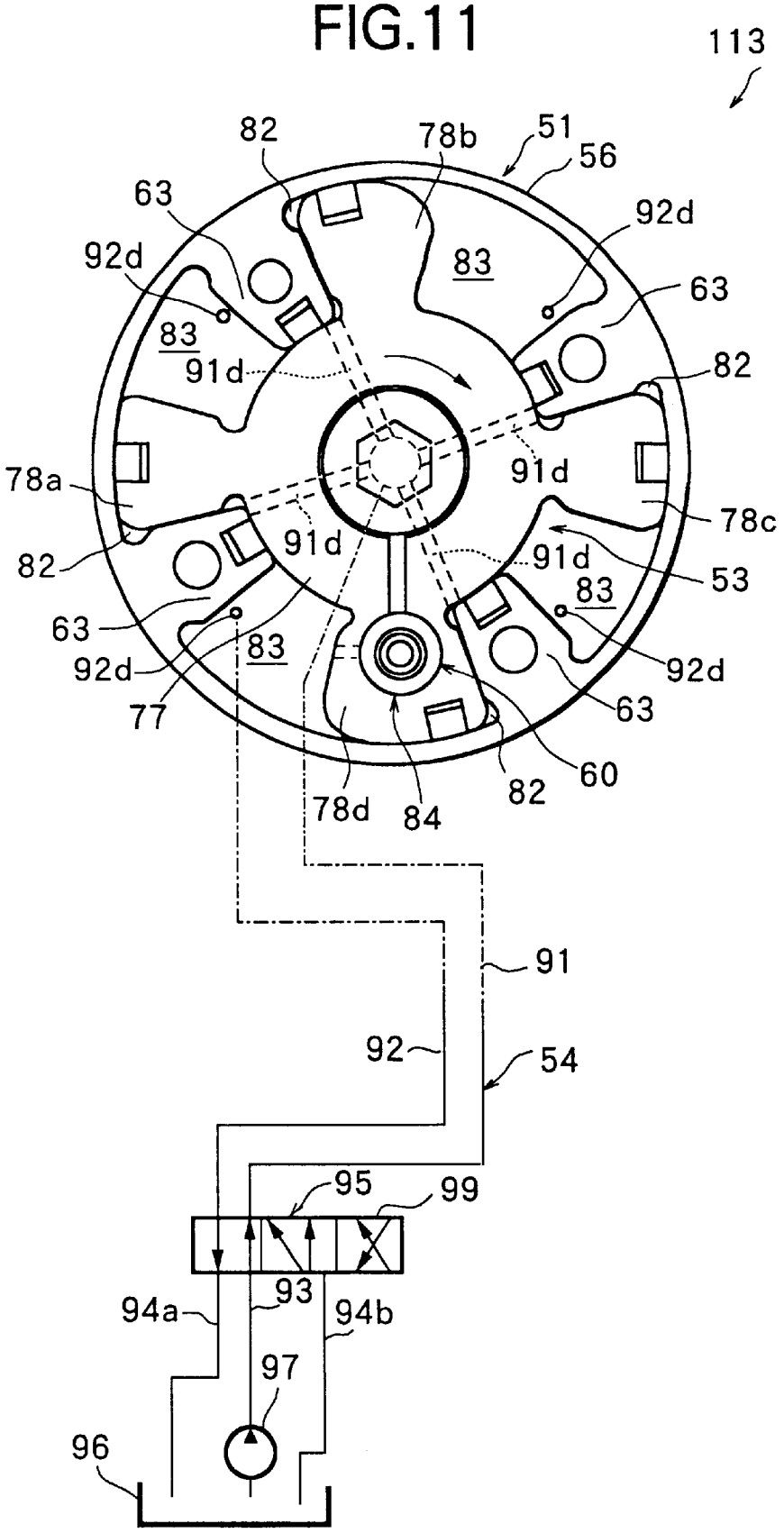
FIG. 11 is a longitudinal cross section view of a variable valve timing (VTC) mechanism.

Next, the structure of variable valve timing (VTC) mechanism 113 will be described based on FIG. 11.

Variable valve timing (VTC) mechanism 113 is a so-called vane type variable valve timing mechanism, and comprises: a cam sprocket 51 (timing sprocket) which is rotatably driven by a crankshaft 120 via a timing chain; a rotation member 53 secured to an end portion of an intake side camshaft 13 and rotatably housed inside cam sprocket 51; a hydraulic circuit 54 that relatively rotates rotation member 53 with respect to cam sprocket 51; and a lock mechanism 60 that selectively locks a relative rotation position between cam sprocket 51 and rotation member 53 at predetermined positions.

Cam sprocket 51 comprises: a rotation portion (not shown in the figure) having on an outer periphery thereof, teeth for engaging with timing chain (or timing belt); a housing 56 located forward of the rotation portion, for rotatably housing rotation member 53; and a front cover and a rear cover (not shown in the figure) for closing the front and rear openings of housing 56.

Housing 56 presents a cylindrical shape formed with both front and rear ends open and with four partition portions 63 protrudingly provided at positions on the inner peripheral face at 90° in the circumferential direction, four partition portions 63 presenting a trapezoidal shape in transverse section and being respectively provided along the axial direction of housing 56.

Rotation member 53 is secured to the front end portion of camshaft and comprises an annular base portion 77 having four vanes 78*a*, 78*b*, 78*c*, and 78*d* provided on an outer peripheral face of base portion 77 at 90° in the circumferential direction.

First through fourth vanes 78*a* to 78*d* present respective cross-sections of approximate trapezoidal shapes. The vanes are disposed in recess portions between each partition portion 63 so as to form spaces in the recess portions to the front and rear in the rotation direction. An advance angle side hydraulic chambers 82 and a retarded angle side hydraulic chambers 83 are thus formed.

Lock mechanism 60 has a construction such that a lock pin 84 is inserted into an engagement hole (not shown in the figure) at a rotation position (in the reference operating condition) on the maximum retarded angle side of rotation member 53.

Hydraulic circuit 54 has a dual system oil pressure passage, namely a first oil pressure passage 91 for supplying and discharging oil pressure with respect to advance angle side hydraulic chambers 82, and a second oil pressure passage 92 for supplying and discharging oil pressure with respect to retarded angle side hydraulic chambers 83. To these two oil pressure passages 91 and 92 are connected a supply passage 93 and drain passages 94*a* and 94*b*, respectively, via an electromagnetic switching valve 95 for switching the passages.

An engine driven oil pump 97 for pumping oil in an oil pan 96 is provided in supply passage 93, and the downstream ends of drain passages 94*a* and 94*b* are communicated with oil pan 96.

First oil pressure passage 91 is formed substantially radially in a base 77 of rotation member 53, and connected to four branching paths 91*d* communicating with each advance angle side hydraulic chamber 82. Second oil pressure passage 92 is connected to four oil galleries 92*d* opening to each retarded angle side hydraulic chamber 83.

With electromagnetic switching valve 95, an internal spool valve is arranged so as to control the switching between respective oil pressure passages 91 and 92, and supply passage 93 and drain passages 94*a* and 94*b*.

Engine control unit 114 controls the power supply quantity for an electromagnetic actuator 99 that drives electromagnetic switching valve 95, based on a duty control signal superimposed with a dither signal.

For example, when a control signal of duty ratio 0% (OFF signal) is output to electromagnetic actuator 99, the hydraulic fluid pumped from oil pump 47 is supplied to retarded angle side hydraulic chambers 83 via second oil pressure passage 92, and the hydraulic fluid in advance angle side hydraulic chambers 82 is discharged into oil pan 96 from first drain passage 94*a* via first oil pressure passage 91. Consequently, an inner pressure of retarded angle side hydraulic chambers 83 becomes a high pressure while an inner pressure of advance angle side hydraulic chambers 82 becomes a low pressure, and rotation member 53 is rotated to the most retarded angle side by means of vanes 78*a* to 78*d*. The result of this is that a valve opening period is delayed relative to a rotation phase angle of crankshaft.

On the other hand, when a control signal of duty ratio 100% (ON signal) is output to electromagnetic actuator 99, the hydraulic fluid is supplied to inside of advance angle side hydraulic chambers 82 via first oil pressure passage 91, and the hydraulic fluid in retarded angle side hydraulic chambers 83 is discharged to oil pan 96 via second oil pressure passage 92, and second drain passage 94*b*, so that retarded angle side hydraulic chambers 83 become a low pressure.

Therefore, rotation member 53 is rotated to the full to the advance angle side by means of vanes 78*a* to 78*d*. Due to this, the opening period of intake valve 105 is advanced relative to the rotation phase angle of crankshaft.

Next, there will be described controls of electronically controlled throttle 104, variable valve event and lift (VEL) mechanism 112 and variable valve timing (VTC) mechanism 113, by engine control unit 114, referring to block diagrams of FIG. 12 to FIG. 14.

Figure 12:
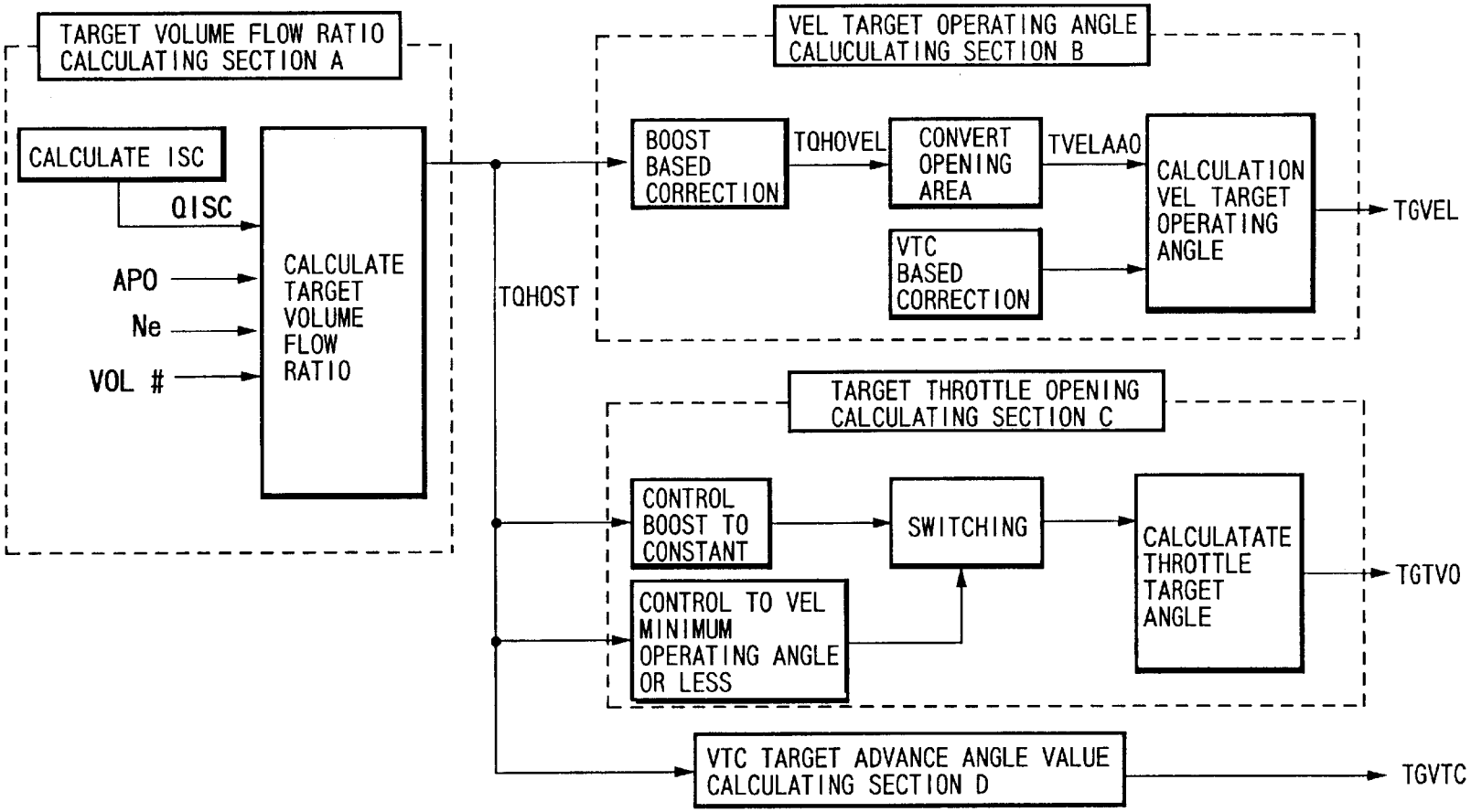
FIG. 12 is a control block diagram showing an intake air amount control.

As shown in FIG. 12, engine control unit 114 comprises a target volume flow ratio calculating section A, a target VEL operating angle calculating section B, a target throttle calculating section C and a target VTC advance angle value calculating section D.

In target volume flow ratio calculating section A, a target volume flow ratio TQH0ST (target intake air amount) of engine 101 is calculated in the following manner.

Firstly, a requested air amount Q0 corresponding to accelerator opening APO and engine rotation speed Ne is calculated, and also a requested ISC air amount QISC requested in an idle rotation speed control (ISC) is calculated.

Then, a total value Q of requested air amount Q0 and requested ISC air amount QISC is obtained (Q=Q0+QISC), and the resultant total value Q is divided by engine rotation speed Ne and an effective discharge amount (entire cylinder volume) VOL# to calculate target volume flow ratio TQH0ST (TQH0ST=Q/(Ne.VOL#)).

In target VEL operating angle calculating section B, target volume flow ratio TQH0ST is corrected according to an intake negative pressure. Further, a target operating angle TGVEL (target valve lift amount) of control shaft 16 in variable valve event and lift (VEL) mechanism 112 is calculated, based on a post-corrected target volume flow ratio TQH0VEL and a correction value corresponding to a change in valve flow loss due to valve timing controlled by variable valve timing (VTC) mechanism 113.

Then, DC servo motor 121 is feedback controlled, so that an actual operating angle coincides with target operating angle TGVEL.

In target throttle opening calculating section C, a volume flow ratio requested for throttle valve 103*b* is calculated to control the intake negative pressure to be constant.

Further, when target operating angle TGVEL (target valve lift amount) larger than a value equivalent to target volume flow ratio TQH0ST is set depending on a limitation of controllable minimum valve lift amount in variable valve event and lift (VEL) mechanism 112, in the calculation of target operating angle TGVEL, a volume flow ratio for obtaining target volume flow ratio TQH0ST is calculated by throttling throttle valve 103*b*.

Here, a smaller one is selected from the volume flow ratio for controlling the intake negative pressure to be constant and the volume flow ratio for compensating for an excess portion of volume flow ratio controlled by intake valve 105, and the selected volume flow ratio is converted into a target angle TGTVO of throttle valve 103*b*.

Then, throttle motor 103*a* is feedback controlled so that an angle of throttle valve 103*b* coincides with target angle TGTVO.

Target VTC advance angle value calculating section D calculates a target valve overlap amount, and calculates a target advance angle TGVTC (target valve timing) in variable valve timing (VTC) mechanism 113 so as to achieve the target valve overlap amount.

Figure 13:
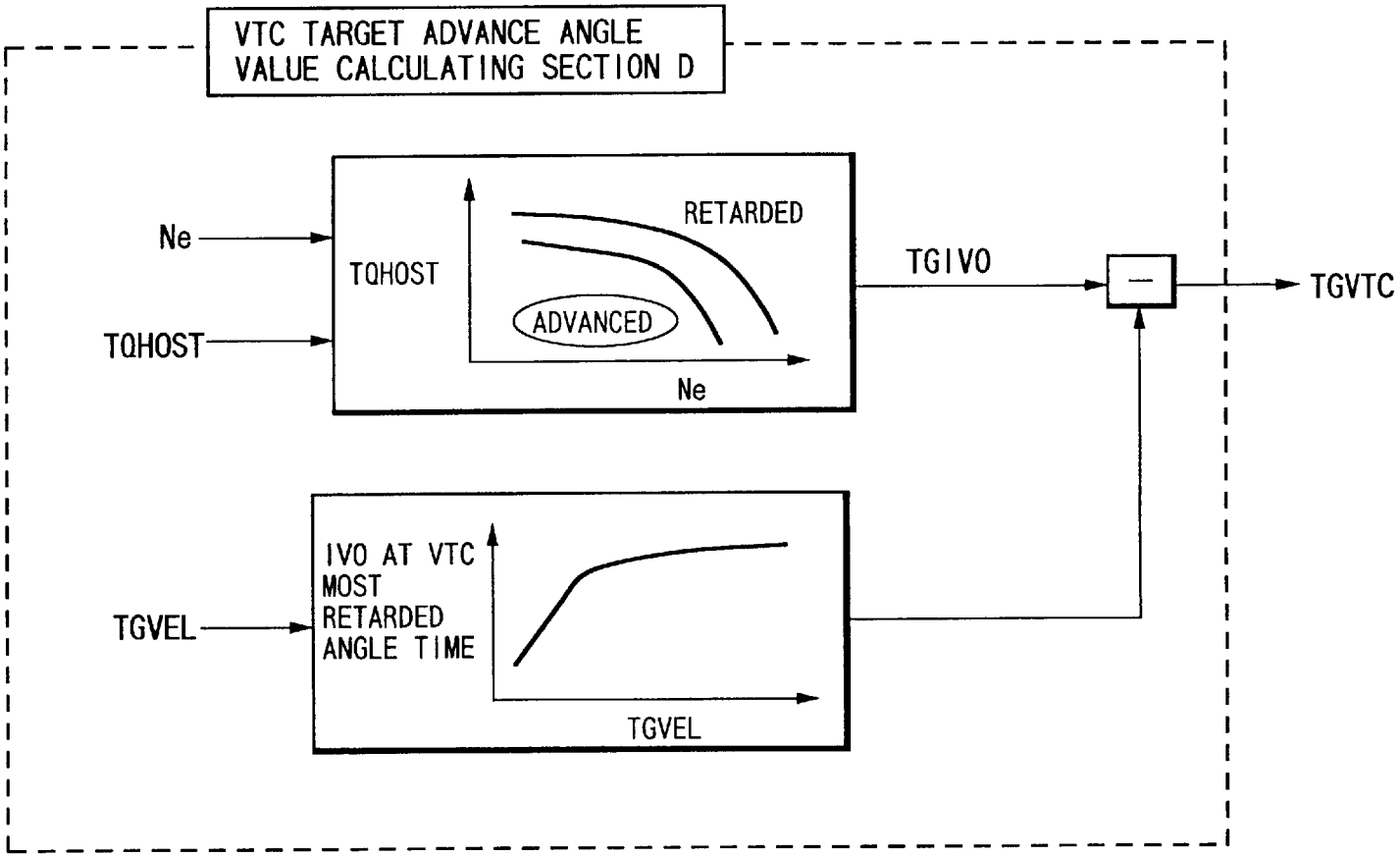
FIG. 13 is a block diagram showing the detail of a target VTC advance angle value calculating section.

Specifically, as shown in FIG. 13, target opening timing TGIVO of intake valve 105 equivalent to the target valve overlap amount is calculated based on target volume flow ratio TQHOST representing an engine load, and engine rotation speed Ne.

Here, the opening timing of intake valve 105 is calculated as an advance angle value of from the top dead center to the opening timing.

In this embodiment, target opening timing TGIVO corresponding to the target valve overlap amount according to the engine load and the engine rotation speed is calculated, since the valve overlap amount is determined at the time when closing timing of exhaust valve 107 is constant and at the opening timing of intake valve 105.

Assuming that the valve timing is controlled to the most retarded angle side by variable valve timing (VTC) mechanism 113 based on target operating angle TGVEL (target valve lift amount), opening timing VELIVO of intake valve 105 at reference valve timing is obtained.

Then, opening timing VELIVO corresponding to target operating angle TGVEL is subtracted from target opening timing TGIVO, to thereby calculate a requested advance angle value of opening timing IVO of intake valve 105, and this requested advance angle value is output as a target advance angle amount TGVTC (target valve timing).

Then, electromagnetic actuator 99 is feedback controlled in order to advance, by target advance angle TGVTC, a rotation phase of the camshaft relative to the crankshaft.

As described above, if the constitution is such that target advancing angle amount TGVTC (target valve timing) in variable valve timing mechanism VTC 113 is set, it is possible to maintain the valve overlap amount at the requested value corresponding to operating conditions while controlling the valve lift amount of intake valve 105, so as to obtain target volume flow ratio TQH0ST.

It is therefore possible to avoid a reduction in drivability (reduction in volume efficiency, blow-by and spit-back of unburned gas) due to excess or lack of the valve overlap amount.

Figure 14:
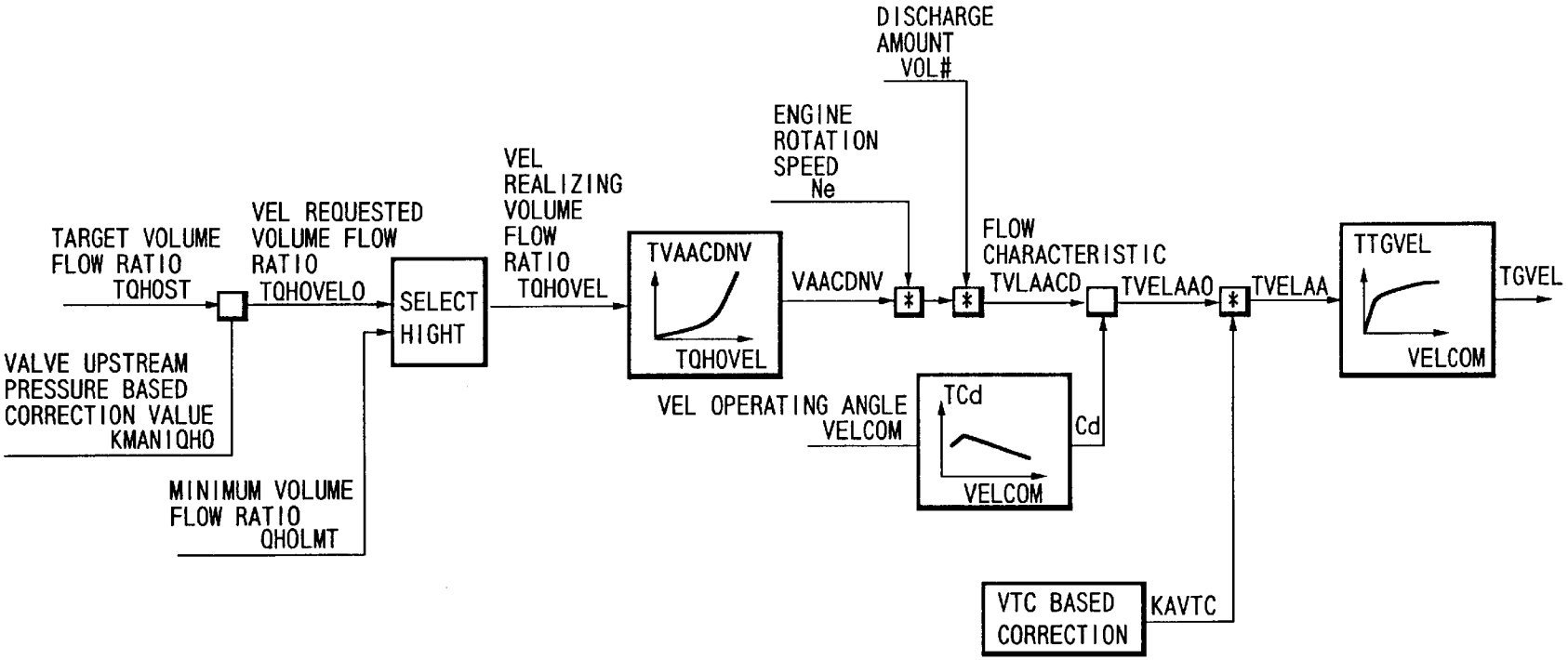
FIG. 14 is a block diagram showing the detail of a target VEL operating angle calculating section.

FIG. 14 shows the detail of target VEL operating angle calculating section B.

Target volume flow ratio TQH0ST is corrected by a correction value KMNIQH0 corresponding to the intake negative pressure. Then, a larger one of post-corrected target volume flow ratio TQH0VEL0 and a minimum volume flow ratio QH0LMT controllable by means of the valve lift amount control by variable valve event and lift (VEL) mechanism 112, is selected to be output as a target volume flow ratio TQH0VEL.

Here, when minimum volume flow ratio QH0LMT is selected, in target throttle opening calculating section C, a throttling amount of throttle valve 103*b* in order to obtain target volume flow ratio TQH0VEL is set, and the volume flow ratio is controlled to target volume flow ratio TQH0VEL by cooperatively performing the valve lift amount control of intake valve 105 and the throttling amount control of throttle valve 103*b*.

Target volume flow ratio TQH0VEL is converted into a state amount VAACDNV. State amount VAACDNV is multiplied by engine rotation speed Ne and effective discharge amount (entire cylinder volume) VOL#, to be converted into a total opening area TVLAACD required for intake valve 105.

Total opening area TVELAACD is corrected by flow loss coefficients Cd, KAVTC corresponding to valve lift amount VELCOM and valve timing, and then is converted into target operating angle TGVEL.

In the above-mentioned embodiment, the target valve overlap amount is obtained by controlling the valve timing of intake valve 105. However, the constitution may be such that there is provided a variable valve timing mechanism varying the valve timing of exhaust valve 107 to obtain the target valve overlap amount by controlling the valve timing of exhaust valve 107 or by controlling the valve timing of intake valve 105 and exhaust valve 107.

It should be further noted that the variable valve event and lift mechanism and the variable valve timing mechanism are not limited to those described in the embodiments.

The entire contents of Japanese Patent Application No. 2001-325210, filed Oct. 23, 2001, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention are provided for illustration only, and not for the purpose of limiting the invention as defined by the appended claims and their equivalents.

What is claimed are:

1. A variable valve control apparatus for an engine, comprising:

a variable valve event and lift mechanism varying a valve lift amount of an engine valve;

a variable valve timing mechanism varying a phase of the engine valve relative to a crankshaft during an opening period of the engine valve;

an operating condition detector detecting operating conditions of the engine; and a control unit that receives a detection signal from said operating condition detector, and outputs control signals to said variable valve event and lift mechanism and said variable valve timing mechanism based on said detection signal, wherein said control unit:

calculates a target valve lift amount and a target valve overlap amount based on the operating conditions of the engine;

calculates a target valve timing based on said target valve lift amount and said target valve overlap amount;

outputs a control signal to said variable valve event and lift mechanism based on said target valve lift amount; and outputs a control signal to said variable valve timing mechanism based on said target valve timing.

2. A variable valve control apparatus for an according to claim 1, wherein said variable valve event and lift mechanism is the one varying a valve lift amount of an intake valve; and said control unit:

calculates a target intake air amount of the engine based on the operating conditions of said engine; and calculates a target valve lift amount of said intake valve based on said target intake air amount.

3. A variable valve control apparatus for an according to claim 1, wherein said operating condition detector detects an engine load and an engine rotation speed, and said control unit calculates said target valve overlap amount based on said engine load and said engine rotation speed.

4. A variable valve control apparatus for an according to claim 1, wherein said control unit calculates target valve timing based on a deviation between said target valve overlap amount, and a valve overlap amount at reference valve timing and in said target valve lift amount.

5. A variable valve control apparatus for an according to claim 1, wherein said variable valve event and lift mechanism is the one varying a valve lift amount of an intake valve, and said variable valve timing mechanism is the one varying valve timing of the intake valve; and said control unit calculates target valve timing of the intake valve based on a deviation between opening timing of the intake valve corresponding to said target valve lift amount in a most retarded angle state of the valve timing, and target opening timing of the intake valve corresponding to said target valve overlap amount.

6. A variable valve control apparatus for an according to claim 1, wherein said variable valve event and lift mechanism is the one varying a valve lift amount of an intake valve, and said variable valve timing mechanism is the one varying valve timing of the intake valve; and said control unit:

calculates a target intake air amount of the engine based on the operating conditions of the engine;

calculates a target valve lift amount of said intake valve based on said target intake air amount;

calculates a target valve overlap amount based on the operating conditions of said engine; and calculates target valve timing of the intake valve based on a deviation between opening timing of the intake valve corresponding to said target valve lift amount in a most retarded angle state of the valve timing, and target opening timing of the intake valve corresponding to said target valve overlap amount.

7. A variable valve control apparatus for an according to claim 1, wherein said variable valve event and lift mechanism comprises:

a drive shaft rotating in synchronism with a crankshaft;

a drive cam fixed to said drive shaft;

a swing cam swinging to operate said valve to open and close;

a transmission mechanism with one end connected to said drive cam side and the other end connected to said swing cam side;

a control shaft having a control cam changing the position of said transmission mechanism; and an actuator rotating said control shaft, and continuously varies the valve lift amount of the engine valve by rotatably controlling said control shaft by said actuator.

8. A variable valve control apparatus for an according to claim 7, wherein said variable valve timing mechanism continuously varies a rotation phase of said drive shaft relative to the crankshaft.

9. A variable valve control apparatus for an according to claim 8, wherein said variable valve timing mechanism includes:

a housing formed integrally with a sprocket which is driven to rotate by the crankshaft;

vanes secured to said drive shaft and housed inside said housing; and a hydraulic circuit that supplies a hydraulic pressure into a hydraulic chamber surrounded by said vanes and said housing to vary a relative rotation angle of said vanes relative to said housing.

10. A variable valve control apparatus for an engine, comprising:

variable valve event and lift means for varying a valve lift amount of an engine valve;

variable valve timing means for varying a phase of the engine valve relative to a crankshaft during an opening period of the engine valve;

operating condition detecting means for detecting operating conditions of the engine;

target valve lift amount calculating means for calculating a target valve lift amount based on said operating conditions;

target valve overlap amount calculating means for calculating a target valve overlap amount based on said operating conditions;

target valve timing calculating means for calculating target valve timing based on said target valve lift amount and said target valve overlap amount; and control means for outputting control signals to said variable valve event and lift means and said variable valve timing means, based on said target valve lift amount and said target valve timing.

11. A variable valve control method for an engine, for controlling a variable valve event and lift mechanism varying a valve lift amount of an engine valve and a variable valve timing mechanism varying a phase of the engine valve relative to a crankshaft during an opening period of the engine valve, comprising the steps of:

detecting operating conditions of the engine;

calculating a target valve lift amount based on said operating conditions;

calculating a target valve overlap amount based on said operating conditions;

calculating target valve timing based on said target valve lift amount and said target valve overlap amount;

outputting a control signal to said variable valve event and lift mechanism based on said target valve lift amount; and outputting a control signal to said variable valve timing mechanism based on said target valve timing.

12. A variable valve control method for an according to claim 11, wherein said variable valve event and lift mechanism is the one varying a valve lift amount of an intake valve; and said step of calculating a target valve lift amount comprises the steps of:

calculating a target intake air amount of the engine based on said operating conditions; and calculating a target valve lift amount of said intake valve based on said target intake air amount.

13. A variable valve control method for an according to claim 11, wherein said step of detecting operating conditions detects an engine load and an engine rotation speed as the operating conditions, and said step of calculating a target valve overlap amount calculates said target valve overlap amount based on said engine load and said engine rotation speed.

14. A variable valve control method for an according to claim 11, wherein said step of calculating target valve timing calculates target valve timing based on a deviation between said target valve overlap amount, and a valve overlap amount at reference valve timing and in said target valve lift amount.

15. A variable valve control method for an according to claim 11, wherein said variable valve event and lift mechanism is the one varying a valve lift amount of an intake valve, and said variable valve timing mechanism is the one varying valve timing of the intake valve; and said step of calculating target valve timing calculates target valve timing of the intake valve based on a deviation between opening timing of the intake valve corresponding to said target valve lift amount in a most retarded angle state of the valve timing, and target opening timing of the intake valve corresponding to said target valve overlap amount.

16. A variable valve control method for an according to claim 11, wherein said variable valve event and lift mechanism is the one varying a valve lift amount of an intake valve, and said variable valve timing mechanism is the one varying valve timing of the intake valve; and said step of calculating a target valve lift amount:

calculates a target intake air amount of the engine based on the operating conditions of the engine; and calculates a target valve lift amount of said intake valve based on said target intake air amount, and said step of calculating target valve timing;

calculates target valve timing of the intake valve based on a deviation between opening timing of the intake valve corresponding to said target valve lift amount in a most retarded angle state of the valve timing, and target opening timing of the intake valve corresponding to said target valve overlap amount.

17. A variable valve control method for an according to claim 11, wherein said variable valve event and lift mechanism comprises:

a drive shaft rotating in synchronism with a crankshaft;

a drive cam fixed to said drive shaft;

a swing cam swinging to operate said valve to open and close;

a transmission mechanism with one end connected to said drive cam side and the other end connected to said swing cam side;

a control shaft having a control cam changing the position of said transmission mechanism; and an actuator rotating said control shaft, and continuously varies the valve lift amount of the engine valve by rotatably controlling said control shaft by said actuator.

18. A variable valve control method for an according to claim 17, wherein said variable valve timing mechanism continuously varies a rotation phase of said drive shaft relative to the crankshaft.

19. A variable valve control method for an according to claim 18, wherein said variable valve timing mechanism includes:

a housing formed integrally with a sprocket which is driven to rotate by the crankshaft;

vanes secured to said drive shaft and housed inside said housing; and a hydraulic circuit that supplies a hydraulic pressure into a hydraulic chamber surrounded by said vanes and said housing to vary a relative rotational angle of said vanes relative to said housing.

* * * * *